US009306297B2

(12) United States Patent
Bishop

(10) Patent No.: US 9,306,297 B2
(45) **Date of Patent: *Apr. 5, 2016**

(54) INTERLOCKING POKE HOME CONTACT

(71) Applicant: AVX Corporation, Myrtle Beach, SC (US)

(72) Inventor: Peter Bishop, Cambridgeshire (GB)

(73) Assignee: AVX CORPORATION, Myrtle Beach, SC (US)

( * ) Notice: Subject to any disclaimer, the term of this patent is extended or adjusted under 35 U.S.C. 154(b) by 49 days.

This patent is subject to a terminal disclaimer.

(21) Appl. No.: 14/264,777

(22) Filed: Apr. 29, 2014

(65) Prior Publication Data

US 2015/0311603 A1 Oct. 29, 2015

(51) Int. Cl.
*H01R 4/18* (2006.01)
*H01R 4/48* (2006.01)

(52) U.S. Cl.
CPC ..... *H01R 4/4818* (2013.01)

(58) Field of Classification Search
CPC ..... H01R 4/4818
USPC ..... 439/856, 857, 853, 858
See application file for complete search history.

(56) References Cited

U.S. PATENT DOCUMENTS

| | | | | |
|---|---|---|---|---|
| 3,479,634 | A * | 11/1969 | Pritulsky | 439/560 |
| 3,678,261 | A * | 7/1972 | McNeil | 362/307 |
| 3,824,557 | A * | 7/1974 | Mallon | 439/857 |
| 4,076,369 | A * | 2/1978 | Ostapovitch | 439/852 |
| 6,439,935 | B2 * | 8/2002 | Saka et al. | 439/852 |
| 7,357,651 | B2 * | 4/2008 | Minoura et al. | 439/82 |
| 8,182,299 | B2 * | 5/2012 | Schrader | 439/857 |
| 8,721,376 | B1 * | 5/2014 | Bishop | 439/853 |
| 2004/0077231 | A1 * | 4/2004 | Harada et al. | 439/856 |
| 2005/0287878 | A1 * | 12/2005 | Urbaniak et al. | 439/856 |
| 2006/0292937 | A1 * | 12/2006 | Morello et al. | 439/856 |
| 2010/0210149 | A1 * | 8/2010 | Yu et al. | 439/744 |

* cited by examiner

*Primary Examiner* — Abdullah Riyami
*Assistant Examiner* — Nelson R Burgos-Guntin
(74) *Attorney, Agent, or Firm* — Foley & Lardner LLP

(57) ABSTRACT

A single element electrical connector includes a single conductive contact element formed into a cage structure having a wire insert end and a wire contact end along a longitudinal centerline axis of the connector. One wall of the cage structure includes a tab that extends into a recess included in another wall of the cage structure. The cage structure defines an upper pick-up surface having a surface area suitable for placement of a suction nozzle of a vacuum transfer device, as well as a pair of contact tines biased towards the centerline axis to define a contact pinch point for an exposed core of a wire inserted into the connector. A contact surface is defined by a member of the cage structure for electrical mating contact with a respective contact element on a component on which the connector is mounted.

20 Claims, 4 Drawing Sheets

INTERLOCKING POKE HOME CONTACT

BACKGROUND

The following description is provided to assist the understanding of the reader. None of the information provided or references cited is admitted to be prior art.

Various types of connectors are used for forming connections between an insulated wire and any manner of electronic component, such as a printed circuit board (PCB). These connectors are typically available as sockets, plugs, and shrouded headers in a vast range of sizes, pitches, and plating options.

SUMMARY

Disclosed herein are embodiments of an electrical connector that is well suited for connecting at least one insulated conductive core wire to an electrical component, such as a PCB. Connectors according to illustrative embodiments are not limited to use with boards, but may be used in any application where a secure electrical connection is desired between wires and any other type of component. The connectors described herein that are used to connect wires to PCB's are discussed for illustrative purposes only. The embodiments disclosed herein are rugged, reliable, and simple in design.

In accordance with illustrative embodiments, the connector is a single element connector in that it is formed from a single conductive contact member and does not include an insulative body or molding. The connector is suited for a pick-and-place mounting process where a vacuum transfer device places the connector for subsequent surface mounting to a PCB, as is understood by those skilled in the art. The connectors are not, however, limited to this mounting technique.

An embodiment of a single element electrical connector in accordance with an illustrative embodiment includes a single conductive contact element formed into a cage structure, with this cage structure defining a wire insert end and a wire contact end arranged along a longitudinal centerline axis of the connector. The cage structure includes a wall structure at the insert end that defines an inlet opening for a wire at the insert end. For example, in one embodiment, the wall structure may include a plurality of walls formed into a box-like structure at the insert end, with one of the walls defining an upper pick-up surface having a surface area suitable for placement of a suction nozzle of a vacuum transfer device. The cage structure further includes a pair of contact tines biased towards the centerline axis of the connector downstream of the wall structure at the insert end in an insertion direction of the wire into the connector, with the contact tines defining a contact pinch point for an exposed core of the wire. A component of the cage structure defines a contact surface for electrical mating contact with a respective contact element or pad on the component to which the connector is mounted, such as a PCB.

In an illustrative embodiment, the connector is formed from a single stamped metal sheet bent or otherwise formed into the cage structure. Any number and configuration of cuts, reliefs, and the like, may be formed in the metal sheet to facilitate bending or otherwise shaping the metal sheet into the cage structure having the features described herein.

In an illustrative embodiment, the cage structure includes a plurality of walls bent into a box-like structure having a top wall, bottom wall, and side walls at the insert end of the connector, with the top wall defining the pick-up surface. In one embodiment, the top wall and side walls may be a bent-over extension of the bottom wall that extends to form the box-like structure. In an illustrative embodiment, one wall of the cage structure may have a tab that extends into a recess in another wall of the cage structure. The tab and recess may make the connector stronger, more stable, and more reliable.

The top and bottom walls may be generally parallel in one embodiment, with one or both of the top and bottom walls including a forward portion that is angled towards the centerline axis of the connector to define an upper wire guide (top wall) and/or lower wire guide (bottom wall).

The contact tines may be defined by the cage structure. In a particular embodiment, the contact tines are forward portions of the side walls that are angled towards the centerline axis at the wire contact end of the connector. The tines may include release tabs extending from a forward-most portion of the contact tines, with the release tabs designed to be engaged by a tool to separate the contact tines in order to remove a wire inserted into the connector. The release tabs may extend generally parallel to the centerline axis.

In another embodiment, the cage structure may include an end wire stop wall defined forward of the contact tines in an insertion direction of a wire into the connector, with this wall defining the ultimate end position of the conductive core of the wire in the connector. The stop wall may be defined by the cage structure. For example, in one embodiment, the bottom wall may extend below the contact tines, with the stop wall defined by a forward portion of the bottom wall that is bent upwards towards the centerline axis.

As mentioned, the connector is not limited by its mounting technique to a PCB or other component. In one embodiment, the contact surface is defined by a portion of the bottom wall of the cage structure such that the connector is surface mountable to a contact pad on a PCB with the centerline axis generally parallel to the PCB. In another embodiment, the connector may be intended for a through-board or top mount configuration where the connector extends generally perpendicular to the PCB. In this configuration, the contact surface may be defined by contact feet extending generally transversely from the walls (bottom, top, or side walls).

Illustrative embodiments may also encompass any manner of electrical component assembly that incorporates the unique connector element introduced above and described in detail below to electrically connect one or more wires to an electrical component. For example, the component assembly may include a PCB in electrical mating contact with one or more conductive wires via the electrical connector.

The foregoing summary is illustrative only and is not intended to be in any way limiting. In addition to the illustrative aspects, embodiments, and features described above, further aspects, embodiments, and features will become apparent by reference to the following drawings and the detailed description.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

DETAILED DESCRIPTION

Figure 1:
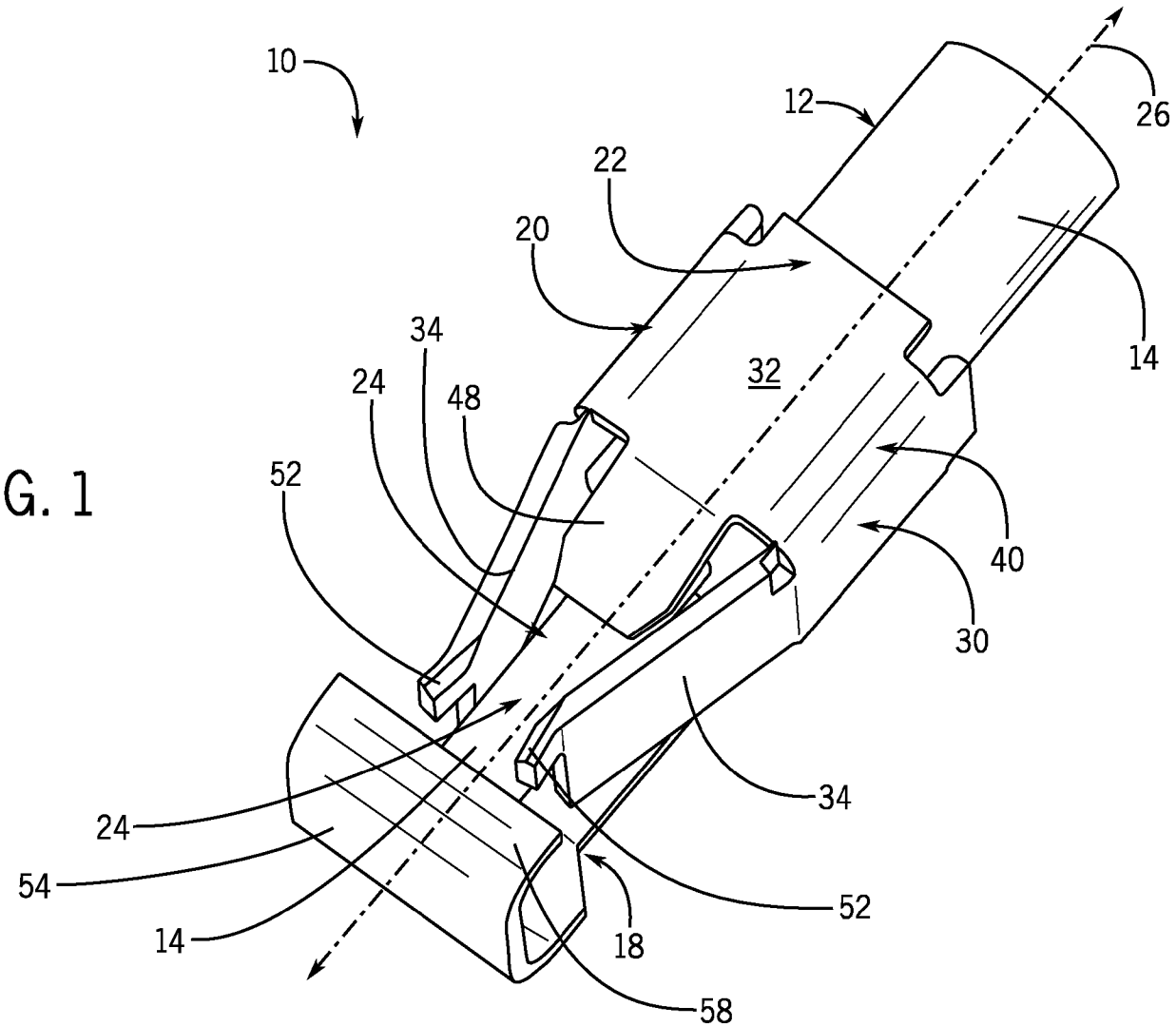
FIG. 1 depicts a perspective view of an embodiment of a connector in accordance with an illustrative embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and make part of this disclosure.

Disclosed herein are embodiments of an electrical connector that is well suited for connecting at least one insulated conductive core wire to an electrical component, such as a PCB. In an illustrative embodiment, a connector is a single element connector that it is formed into a cage structure, with this cage structure defining a wire insert end and a wire contact end arranged along a longitudinal centerline axis of the connector. The cage structure includes a wall structure at the insert end that defines an inlet opening for a wire at the insert end. The connector may be formed from a single stamped metal sheet bent or otherwise formed into the cage structure. In an illustrative embodiment, one wall of the cage structure may have a tab that extends into a recess in another wall of the cage structure. The tab and recess may make the connector stronger, more stable, and more reliable. The cage structure further includes a pair of contact tines biased towards the centerline axis of the connector downstream of the wall structure at the insert end in an insertion direction of the wire into the connector, with the contact tines defining a contact pinch point for an exposed core of the wire. A component of the cage structure defines a contact surface for electrical mating contact with a respective contact element or pad on the component to which the connector is mounted, such as a PCB.

Reference will now be made to various embodiments of the invention, one or more examples of which are illustrated in the figures. The embodiments are provided by way of explanation, and are not meant as limiting. For example, features illustrated or described as part of one embodiment may be used with another embodiment to yield still a further embodiment. It is intended that the disclosed embodiments encompass these and other modifications and variations as come within the scope and spirit of the invention.

Illustrative embodiments of an electrical connector 10 are illustrated in FIGS. 1 through 4. The electrical connector 10 connects the conductive core of an insulated wire to any manner of electrical component, such as a printed circuit board (PCB). For ease of explanation and illustration, the connector 10 is illustrated and referred to herein in the context of connecting wires to a PCB. In addition, the connector 10 is depicted in the figures as a single-way connector in that it includes only a single wire position. Connector 10 is not limited by the number of wire positions. Embodiments that have a cage structure that accommodates more than one wire position are possible. For example, various embodiments may have a cage structure that is formed into a two-way, a three-way connector, etc., in addition to the illustrated single-way connector.

Referring to the figures in general, an embodiment 10 of a single element electrical connector is depicted. The connector 10 is particularly suited for connecting a wire 12 to any manner of electrical component, such as a PCB, as depicted in FIG. 1. The wire 12 may be a stranded or solid core wire having a core 14 surrounded by insulation material 16. Prior to insertion of the wire 12 into the connector 10, a section of the insulation material 16 is stripped away from the core 14 adjacent to the end of the wire 12.

As mentioned above, the connector 10 is a single element connector in that it is formed from a single conductive contact element 18. This element 18 may be any suitable conductive metal material having a gauge and other physical characteristics suitable for maintaining the shape of the connector 10 in the mounting process, as well as in the operating environment of the electrical component to which the connector 10 is mounted.

The single conductive contact element 18 is formed into a cage or cage-like structure depicted generally as element 20. The cage structure 20 includes a wire insert end 22 that defines an inlet opening 28 for insertion of the conductive core wire 12 into the connector 10. The cage structure 20 also defines a wire contact end 24, which is the end of the cage structure at which the exposed conductive core 14 of the wire 12 is contacted by the single conductive contact element 18. The insert end 22 and wire contact end 24 are aligned along a central longitudinal axis 26 of the connector 10.

In an illustrative embodiment, the cage structure 20 includes a wall structure 30 that substantially surrounds the wire 12. The wall structure 30 may include any number and configuration of walls, such as a circular wall, semi-circular wall components, and so forth. At least a portion of the wall structure 30 defines an upper pick-up surface 32. This surface 32 has a surface area that is suitable for placement of a suction nozzle of a vacuum transfer device so that the connectors 10 may be transferred to an electrical component, such as a PCB, in a conventional pick-and-place process, as is understood by those skilled in the art. In an illustrative embodiment, the connectors 10 are supplied in tape form that is fed to a conventional vacuum transfer device in the pick-and-place process.

The cage structure 20 includes a pair of contact tines 34 that are biased towards the centerline axis 26 of the connector 10 downstream of the wall structure 30 in the insertion direction of the wire 12 into the connector 10. These contact tines 34 are defined by sections or cutouts of the single conductive contact element 18 and define a contact pinch point 36 for contact against the exposed core 14 of the wire 12. The pinch point 36 also serves as a clamp point to prevent inadvertent removal of the wire 12 from the connector 10.

The connector 10 includes a contact surface 38 that may be defined by any member or section of the cage structure 20. The contact surface 38 is provided for electrical mating contact with a respective contact element on the electronic component. For example, the contact surface 38 may be defined by any section of the bottom portion or wall of the cage structure 30 that mates with a corresponding contact pad on the PCB, where the connector 10 may be surface mounted directly onto the contact pad of the PCB.

In the illustrated embodiment, the connector 10, in particular the single c conductive contact element 18, is formed from a single metal sheet material that is bent or otherwise formed into the cage structure 30. Any manner of cuts, reliefs, or other structures may be cut or stamped into the single conductive contact element 18 to facilitate forming the single conductive contact element 18 into the overall configuration of the connector 10 as described herein.

In the depicted embodiment, the wall structure 30 includes a plurality of walls that are bent into a box-like structure 40 having a top wall 42, bottom wall 44, and opposite side walls 46. The top wall 42 defines the pick-up surface 32 discussed above. It should also be appreciated that any one of the other walls may also define the pick-up surface 32. The box-like structure 40 may be defined by the walls in various ways. For example, in the depicted embodiment, one of the side walls 46 is a component that is bent upwardly relative to the bottom wall 44, while the top wall 42 is bent laterally relative to one of the side walls 46, and the other side wall 46 is bent downwardly relative to the top wall 42 towards the bottom wall 44.

Figure 2:
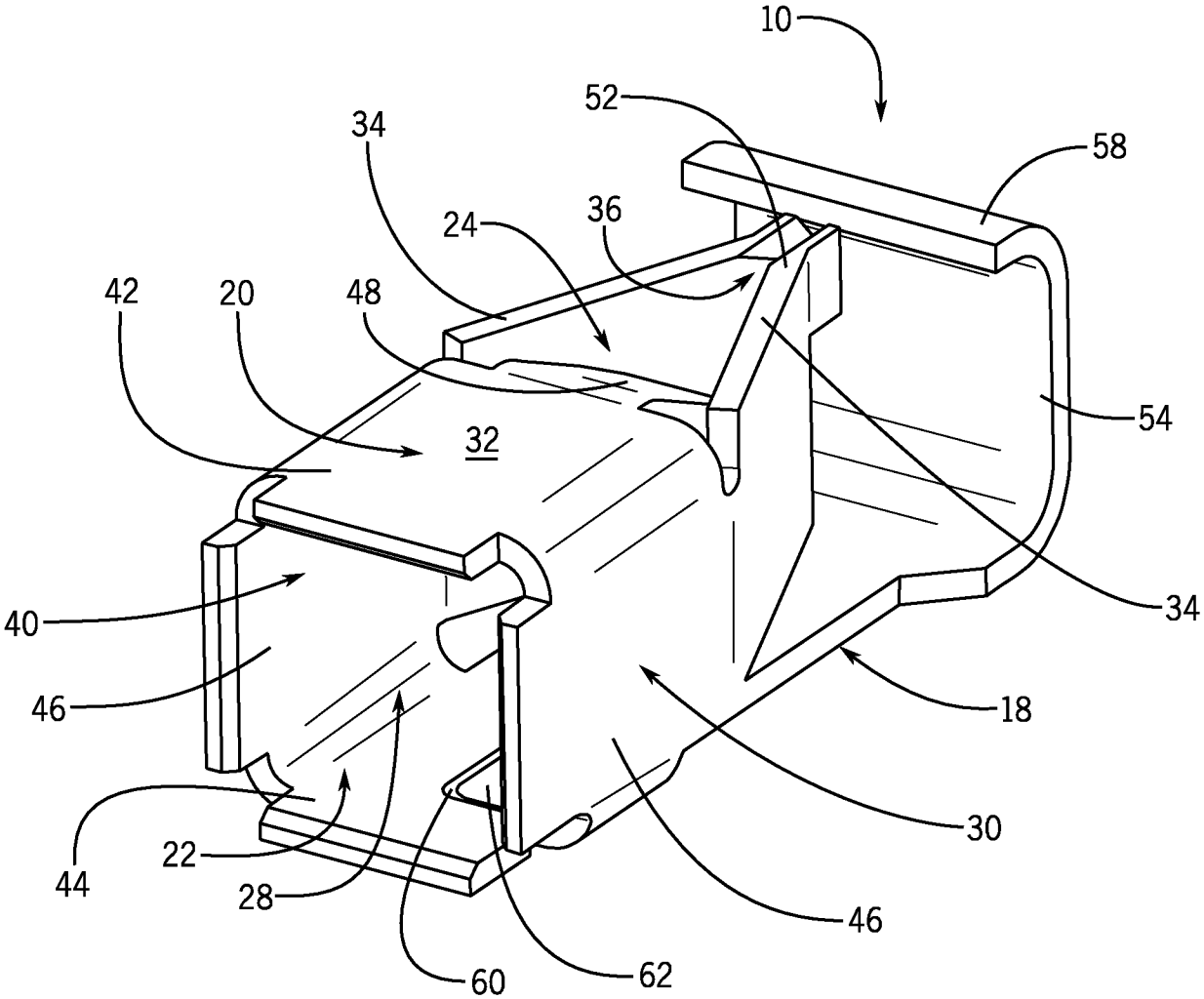
FIG. 2 depicts a perspective top, insert end, and side view of an interlocking connector in accordance with an illustrative embodiment.
Figure 3:
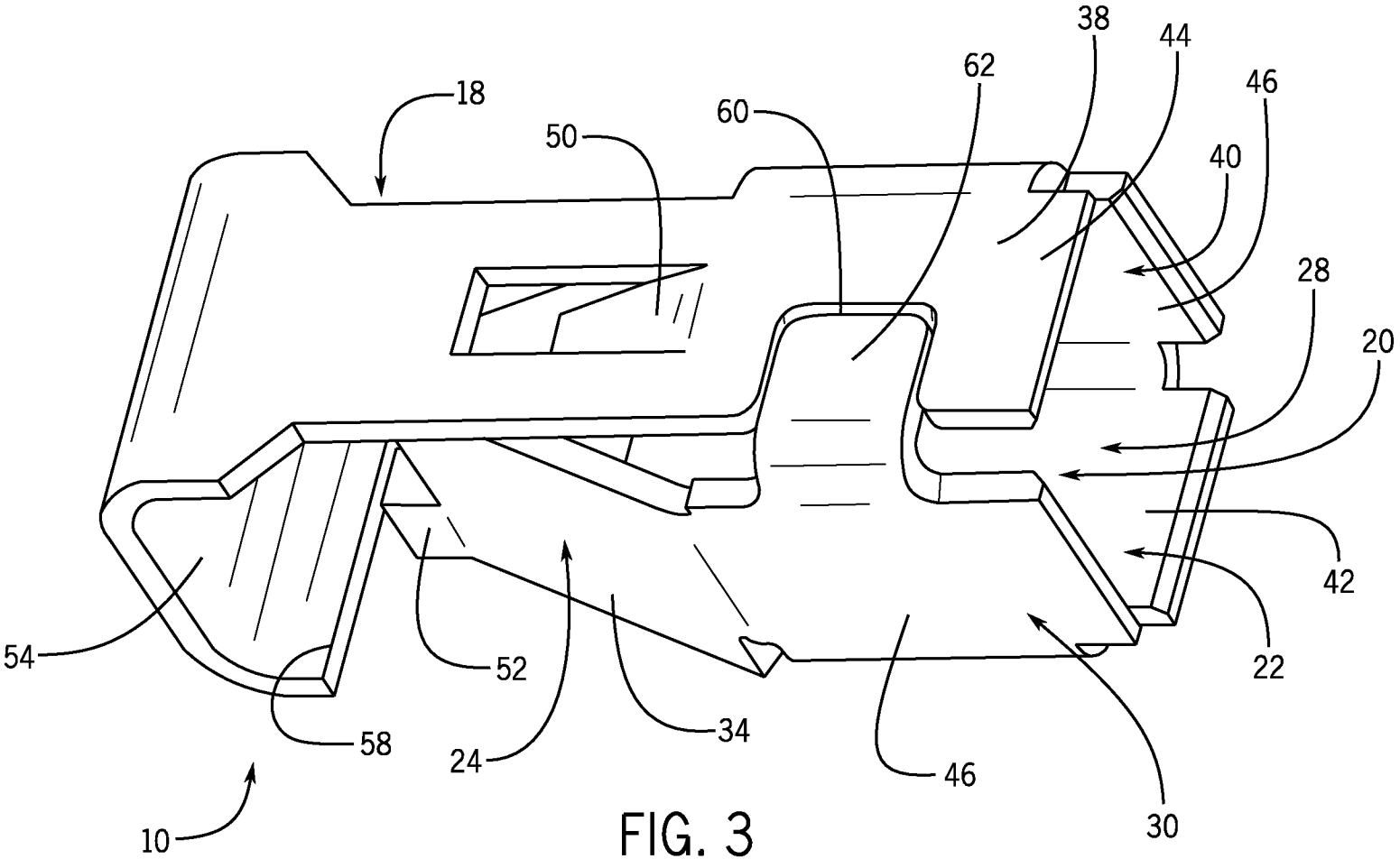
FIG. 3 depicts a perspective bottom, insert end, and side view of an interlocking connector in accordance with an illustrative embodiment.
Figure 4:
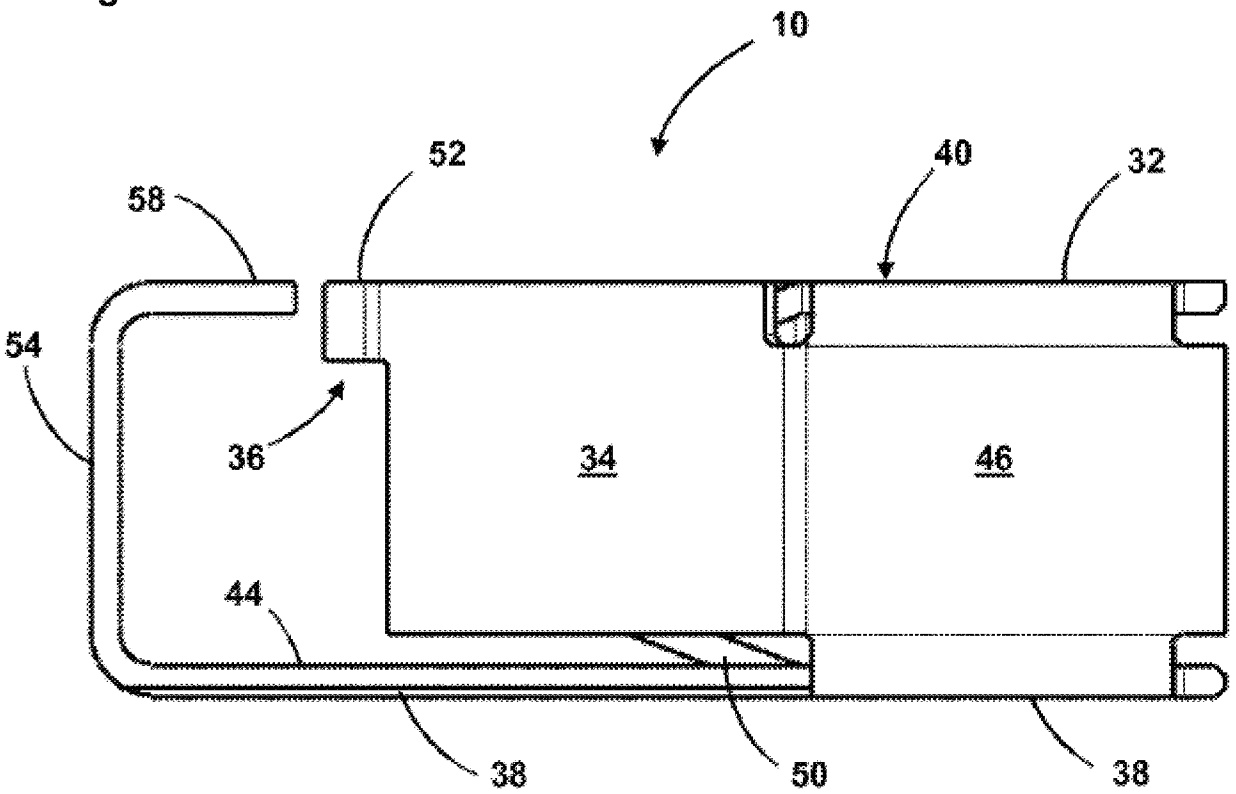
FIG. 4 depicts a side view of an embodiment of a connector in accordance with an illustrative embodiment.

The bottom wall 44 includes a recess 60, which may be cut out of the single conductive contact element 18, seen in FIGS. 2 and 3. In this embodiment, the recess 60 is rectangular. In other various embodiments, the recess may be shaped in any possible way, such as circular, semi-circular, triangular, square, trapezoidal, etc. The recess 60 is on the side of the bottom wall 44 near one of the side walls 46. The side wall 46 has a tab 62, which is shaped to fit into the recess 60. Here, the tab 62 is shaped rectangularly to fit into the recess 60. In other embodiments, the tab 62 may be shaped in many various ways to fit into the shape of the recess 60. The tab 62 is shaped to fit snugly into the recess 60 in a way that makes the connector 10 more rigid and structurally sound. Additionally, if the connector 10 is soldered or otherwise attached to a PCB, a connector 10 with the tab 62 and recess 60 is more robust and resists the pull of a wire that may be inserted into the connector 10. In various alternative embodiments, the tab 62 may be shaped to fit more loosely or snugly into the recess 60 as desired. In the illustrative embodiments, the recess 60 is shown on the bottom wall 44 and the tab 62 is shown on one of the side walls 46. The tab 62 may be formed by bending a part of the single conductive contact element 18 to a substantially right angle from the side wall 46 towards the inlet opening 28.

In an alternative embodiment, the tab 62 may be located on the opposite side wall 46 and the recess 60 may be located on the opposite side of the bottom wall 44 to accommodate the tab 62. In other various embodiments, the recess 60 may be located on any of the walls (side walls 46, bottom wall 44, or top wall 42) and the tab 62 may be located on any of the walls (side walls 46, bottom wall 44, or top wall 42) such that the tab 62 and the recess 60 fit together. In still other embodiments, if the wall structure 30 is circular or semi-circular and there are not distinct walls per se, the wall structure 30 may still have a tab 62 and a recess 60 that fit together to add rigidity and structure to the wall structure 30 and connector 10 as a whole. Similarly, in other embodiments, if the wall structure 30 is any another shape, e.g. a triangle, the wall structure may still accommodate a tab 62 and a recess 60 that fit together to add rigidity and structure to the wall structure 30 and connector 10.

In an illustrative embodiment, the interlocking tab 62 on the base of the contact solders down to a PCB track surface. In other words, the surface with the tab 62 and recess 60 is used as the contact surface 38. The whole box-like structure 40 section of the contact is then rigidly fixed to a PCB which gives a mechanically stronger contact when subjected to forces applied to the wires inserted in the contact 10.

In other various embodiments, the tab 62 and recess 60 may be formed in various locations or used in different ways. For example, the wall with a tab 62 may be used as a contact surface to connect the connector 10 to a PCB or other electrical component. In this embodiment, the tab 62 and recess 60 may be on an adjacent wall to the wall used as the contact surface. In another embodiment, the wall with a recess 60 may be used as the contact surface to connect the connector 10 to a PCB or other electrical component. In this embodiment, the contact surface may include a surface of the tab 62. Additionally, if the contact surface in this embodiment is soldered (or otherwise connected) onto a PCB or other electrical component, the solder or other connection may secure the tab 62 and wall with the recess 60 together, offering further support and rigidity. In any of the embodiments where a wall with the tab 62 or the recess 60 is connected to an electrical component, the wall may be the contact surface that is mounted to the component with the centerline axis of the connector 10 generally parallel to the component. Another way support and rigidity may be enhanced by the embodiment in FIG. 3 is by extending the bottom wall 44 with the recess 60 is underneath the contact tines 34, and further still to a contact wall 54 (to be discussed below). In another embodiment, a connector 10 may have more than one tab and more than one recess. The multiple tabs and recesses may be on any combination of the walls. For example, a wall may have a tab and a recess, while an adjacent wall has a corresponding recess and tab. In another example, two walls may have a tab and two walls may have a recess. In yet another example, a wall may have two tabs, while an adjacent wall has two recesses.

Further, in the embodiment shown in FIG. 3, the wall structure 30 has four corners where the side walls 46, bottom wall 44, and top wall 42 meet. In this embodiment, the tab 62 extends through one of the corners, such that there is no corner without material of the single conductive contact element 18. In other words, there is no corner that has a complete gap or split of the single conductive contact element 18.

In the illustrative embodiment shown in FIG. 3, the tab 62 extends at an angle from one of the side walls 46. The tab 62 extends approximately perpendicular to the side wall 46. In other embodiments, the tab may extend at other various angles. For example, if the wall structure forms a triangular shape instead of a square shape, a tab may extend approximately sixty degrees from one of the walls in order to be parallel with another wall. In another example, the wall structure may be curved, and thus a tab may extend with a curvature of the wall structure. In other embodiments, a tab may not extend at a particular angle in order to be parallel with the wall of a recess.

Certain embodiments of the connector 10 may also include guide surfaces within the cage structure 20 that serve to physically contact and align the wire 12 within in the structure 20. In the illustrated embodiment, for example, an upper wire guide 48 is defined by an angled portion of the top wall 42. This upper wire guide 48 is angled from the generally parallel top wall (parallel to the bottom wall 44) towards the centerline axis 26. Similarly, the bottom wall 44, which may be parallel to the top wall 42, may have a forward portion that is angled towards the centerline axis 26 to define a lower wire guide 50.

As mentioned the contact tines 34 may have various shapes within the cage structure 20. In the illustrated embodiment, the tines 30 are defined by forward portions of each of the side walls 46 that are bent or angled towards the centerline axis 26 to the pinch point 36. In this manner, the tines 34 are biased towards each other (and the centerline axis 26). The tines 34 separate and engage against the conductive core 14 of the wire as the wire is inserted through the tines 34.

In certain embodiments, a release tab 52 may be defined on each of the contact tines 34 generally forward of the pinch point 36. These release tabs 52 provide a location for insertion of a tool between the tines 34 in order to open the tines 34 for removal of the wire 12. The release tabs 52 may formed in various ways. In the illustrated embodiment, the release tabs 52 are defined by generally forwardly extending tabs that are essentially parallel to the centerline axis 26 with the wire 12 removed from the connector 10.

In certain embodiments as depicted in the figures, a wire stop wall 54 at the end of the wire contact end 24 of the cage structure 20 may be included. This contact wall 54 provides a surface against which the conductive core 14 of the wire 12 abuts in the completely inserted position of the wire 12. This contact wall 54 may be formed in various ways. In the illustrated embodiment, the contact wall 54 is formed from a bent-up portion of the bottom wall 44. The wall 54 may further include an overhang or lip 58 that extends back towards the pinch point 36 of the contact tines 34. This overhang 58 may serve to prevent inadvertent removal of the wire 12 in a vertical direction relative to the connector 10.

As mentioned, contact surface 38 may be defined by any portion of the bottom wall 44 (or any other wall) that aligns with a mating contact pad on a PCB. In this embodiment, the connector 10 is suited for conventional surface mount processes.

In an alternate embodiment, the connector may be defined for a thru-board connection where the connector extends through a hole in a PCB. Contact feet may be provided extending laterally from opposing walls, such as the side walls, for mating against a contact pad on either side of the thru-hole in the PCB. In other embodiments, the contact feet may extend laterally from any of the walls or any combination of the walls (top, bottom, side). Similarly, the contact feet may serve for surface mounting of the connector on a PCB where the connector assumes a relatively vertical (i.e., perpendicular) orientation relative to the PCB. In an illustrative embodiment, the contact feet are defined by outwardly bent portions of each side wall. In an alternate embodiment, the contact feet may also be defined by outwardly bent portions of the bottom wall and top wall.

It should be readily appreciated by those skilled in the art that various modifications and variations can be made to the various embodiments and described herein without departing from the scope and spirit of the invention. It is intended that such modifications and variations be encompassed by the appended claims.

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

While certain embodiments have been illustrated and described, it should be understood that changes and modifications can be made therein in accordance with ordinary skill in the art without departing from the technology in its broader aspects as defined in the following claims.

The embodiments, illustratively described herein may suitably be practiced in the absence of any element or elements, limitation or limitations, not specifically disclosed herein. Thus, for example, the terms "comprising," "including," "containing," etc. shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the claimed technology. Additionally, the phrase "consisting essentially of" will be understood to include those elements specifically recited and those additional elements that do not materially affect the basic and novel characteristics of the claimed technology. The phrase "consisting of" excludes any element not specified.

The present disclosure is not to be limited in terms of the particular embodiments described in this application. Many modifications and variations can be made without departing from its spirit and scope, as will be apparent to those skilled in the art. Functionally equivalent methods and compositions within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can of course vary. It is also to be understood that the terminology used herein is for the purpose of describing particular embodiments only, and is not intended to be limiting.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like, include the number recited and refer to ranges which can be subsequently broken down into subranges as discussed above. Finally, as will be understood by one skilled in the art, a range includes each individual member.

All publications, patent applications, issued patents, and other documents referred to in this specification are herein incorporated by reference as if each individual publication, patent application, issued patent, or other document was specifically and individually indicated to be incorporated by reference in its entirety. Definitions that are contained in text incorporated by reference are excluded to the extent that they contradict definitions in this disclosure.

Other embodiments are set forth in the following claims.

What is claimed is:

1. A single element electrical connector configured for connecting wires to a component, the connector comprising:

a single conductive contact element formed into a cage structure having a wire insert end and a wire contact end along a longitudinal centerline axis of the connector, wherein the wire insert end is opposite the wire contact end;

wherein the cage structure comprises a wall structure at the wire insert end defining an inlet opening for a wire, the wall structure defining an upper pick-up surface, wherein the wall structure comprises a plurality of walls bent into a box-like structure that encloses a perimeter of a volume configured to receive the wire, wherein a first wall of the plurality of walls comprises a tab that extends into a recess in a second wall of the plurality of walls;

wherein the cage structure further comprises a pair of contact tines defining a contact pinch point for an exposed core of the wire; and a contact surface defined by a member of the cage structure, wherein the contact surface is configured to form an electrical and physical connection with a respective contact element on the component.

2. The connector of claim 1, wherein the pair of contact tines are biased towards the centerline axis downstream of the wall structure in an insertion direction of the wire into the connector.

3. The connector of claim 1, wherein the at least one of the plurality of walls comprises a forward portion at the second end, and wherein the forward portion is angled toward the centerline axis to define an upper wire guide.

4. The connector of claim 3, wherein the contact pinch point is positioned downstream of the upper wire guide in the insertion direction of the wire.

5. The connector of claim 1, wherein the second wall of the plurality of walls is connected to an electrical component.

6. The connector of claim 5, wherein the connection to the electrical component secures the tab in the recess.

7. The connector of claim 1, wherein the first wall of the plurality of walls is connected to an electrical component.

8. The connector of claim 1, wherein the second wall of the plurality of walls comprises the contact surface, and wherein the contact surface is such that the connector is surface mounted to a component with the centerline axis generally parallel to the component.

9. The connector of claim 1, wherein the second wall of the plurality of walls comprises a split in the single conductive contact element.

10. The connector of claim 9, wherein at the split in the single conductive element, the tab and the recess contact one another.

11. The connector of claim 1, wherein the first wall of the plurality of walls comprises the contact surface, and wherein the contact surface is such that the connector is surface mounted to a component with the centerline axis generally parallel to the component.

12. The connector of claim 1, wherein the tab extends at an angle from the first wall of the plurality of walls, such that the tab is substantially parallel to the second wall of the plurality of walls.

13. The connector of claim 1, wherein the tab fits substantially snugly into the recess such that the tab is held in place by a compression force.

14. The connector of claim 1, wherein the wall structure comprises a plurality of corners where the plurality of walls respectively meet.

15. The connector of claim 14, wherein at each of the plurality of corners the single conductive contact element is present in at least part of the respective corner.

16. The connector of claim 14, wherein each of the plurality of corners do not completely comprise a gap in the single conductive contact element.

17. The connector of claim 1, wherein the connector is formed from a single stamped metal sheet bent into the cage structure, wherein the plurality of walls comprises a top wall, bottom wall, and side walls at the insert end, wherein the top wall defines the pick-up surface, and wherein the at least one of the plurality of walls is the top wall.

18. The connector of claim 17, wherein the contact tines are forward portions of the side walls angled towards the centerline axis.

19. The connector of claim 17, wherein the cage structure further comprises an end wire stop wall defined forward of the contact tines in an insertion direction of a wire into the connector.

20. The connector of claim 19, wherein the bottom wall extends below the contact tines, the stop wall defined by a forward portion of the bottom wall that is bent upwards towards the centerline axis, wherein the end wire stop wall extends perpendicularly from the bottom wall, and wherein the bottom wall is the second wall of the plurality of walls.

* * * * *